US007565979B1

(12) United States Patent
Gibson

(10) Patent No.: US 7,565,979 B1
(45) Date of Patent: Jul. 28, 2009

(54) MEDICINE HOLDING ASSEMBLY

(76) Inventor: Ralph D. Gibson, 9703 Back Acre Dr., Charlotte, NC (US) 28213

( * ) Notice: Subject to any disclaimer, the term of this patent is extended or adjusted under 35 U.S.C. 154(b) by 434 days.

(21) Appl. No.: 11/371,583

(22) Filed: Mar. 10, 2006

(51) Int. Cl.
*B65D 69/00* (2006.01)

(52) U.S. Cl. ..... 206/570; 206/363; 206/438; 206/473

(58) Field of Classification Search ..... 206/570, 206/223, 210, 363, 438, 581, 207, 370, 472, 206/473, 571
See application file for complete search history.

(56) References Cited

U.S. PATENT DOCUMENTS

| | | | | | |
|---|---|---|---|---|---|
| 2,804,969 | A * | 9/1957 | Barnett | 206/229 |
| 4,194,628 | A * | 3/1980 | Campos | 206/570 |
| 4,389,963 | A | 6/1983 | Pearson | |
| 4,429,793 | A * | 2/1984 | Ehmann | 206/570 |
| 4,461,332 | A | 7/1984 | Parkhurst | |
| 4,693,371 | A * | 9/1987 | Malpass | 206/538 |
| 5,207,303 | A * | 5/1993 | Oswalt et al. | 190/108 |
| 5,351,818 | A | 10/1994 | Daneshvar | |
| 5,865,314 | A * | 2/1999 | Jacober | 206/570 |
| 6,179,102 | B1 | 1/2001 | Weber et al. | |
| 6,439,406 | B1 | 8/2002 | Duhon | |
| 6,454,097 | B1 * | 9/2002 | Blanco | 206/570 |
| D466,297 | S | 12/2002 | Raisner et al. | |
| 6,631,805 | B2 * | 10/2003 | Bramen | 206/538 |
| 6,691,863 | B1 * | 2/2004 | Veenstra | 206/5 |
| 6,814,236 | B2 * | 11/2004 | Roshdy | 206/570 |
| 6,935,133 | B2 * | 8/2005 | Keeter et al. | 62/371 |
| 7,004,324 | B1 * | 2/2006 | Delorio | 206/570 |
| 2004/0020813 | A1 * | 2/2004 | Moeller et al. | 206/425 |
| 2005/0029156 | A1 * | 2/2005 | Girzaitis | 206/570 |

* cited by examiner

*Primary Examiner*—Luan K Bui
*Assistant Examiner*—Chun Cheung

(57) ABSTRACT

A medicine holding assembly includes a housing that has a bottom wall and a peripheral wall attached to the bottom wall. A cover has a top wall and a peripheral lip that is attached to the top wall. The top wall has a same size and shape as the bottom wall. The peripheral lip is pivotally coupled to the peripheral wall and the top wall is selectively positionable in a closed position extending over the bottom wall. A closure is attached the housing and is configured to releasably secure the peripheral wall to the peripheral lip when the cover is in the closed position. A plurality of bottom loops is attached to an inner surface of the bottom wall. Pill bottles may be secured to the bottom wall with the bottom loops.

14 Claims, 4 Drawing Sheets

MEDICINE HOLDING ASSEMBLY

BACKGROUND OF THE INVENTION

1. Field of the Invention

The present invention relates to medicine holding devices and more particularly pertains to a new medicine holding device for storing a plurality of pill bottles and other medications and medicine delivery apparatuses.

2. Description of the Prior Art

The use of medicine holding devices is known in the prior art. While these devices fulfill their respective, particular objectives and requirements, the need remains for a device that assists a person in storing and transporting a plurality of pill bottles. In particular, the device should be configured for securing holding a plurality of pill bottles in such a manner that the pill bottles do not strike each other or the sides of the device while being transported. Further, it is preferred that the device be capable of holding a plurality of pills in an organized manner.

SUMMARY OF THE INVENTION

The present invention meets the needs presented above by generally comprising a housing that has a bottom wall and a peripheral wall that is attached to and extends upwardly from the bottom wall. The peripheral wall includes a first side wall, a second side wall, a third side wall and a fourth side wall. The housing includes a cover having a top wall and a peripheral lip that is attached and extends downwardly from the top wall. The top wall has a same size and shape as the bottom wall. The peripheral lip is pivotally coupled to the fourth side wall and the top wall is selectively positionable in a closed position extending over the bottom wall or an open position is spaced from the peripheral wall. A closure is attached the housing and is configured to releasably secure the peripheral wall to the peripheral lip when the cover is in the closed position. A plurality of bottom loops is attached to an inner surface of the bottom wall. Each of the bottom loops comprising a resiliently stretchable material. Pill bottles may be secured to the bottom wall with the bottom loops.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
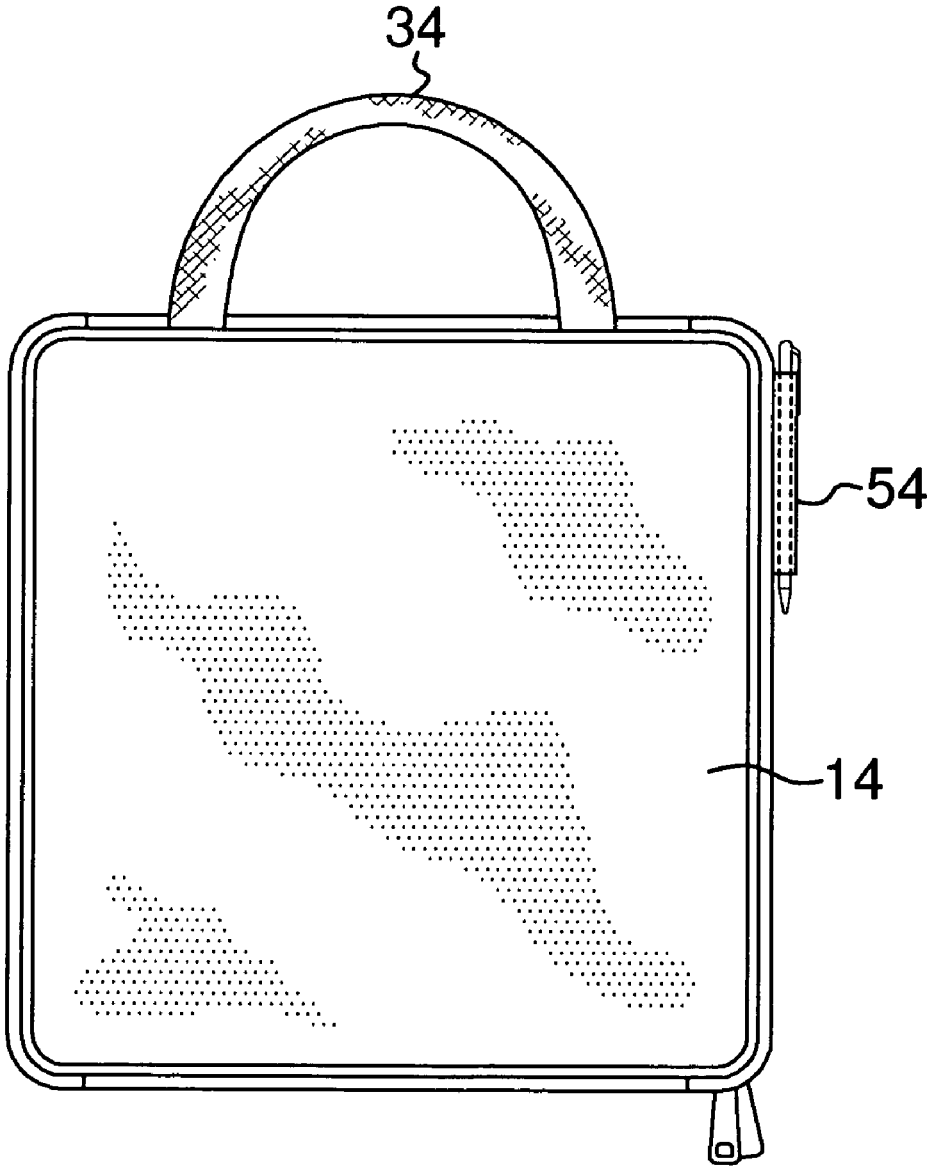
FIG. 1 is a front view of a medicine holding assembly according to the present invention.
Figure 2:
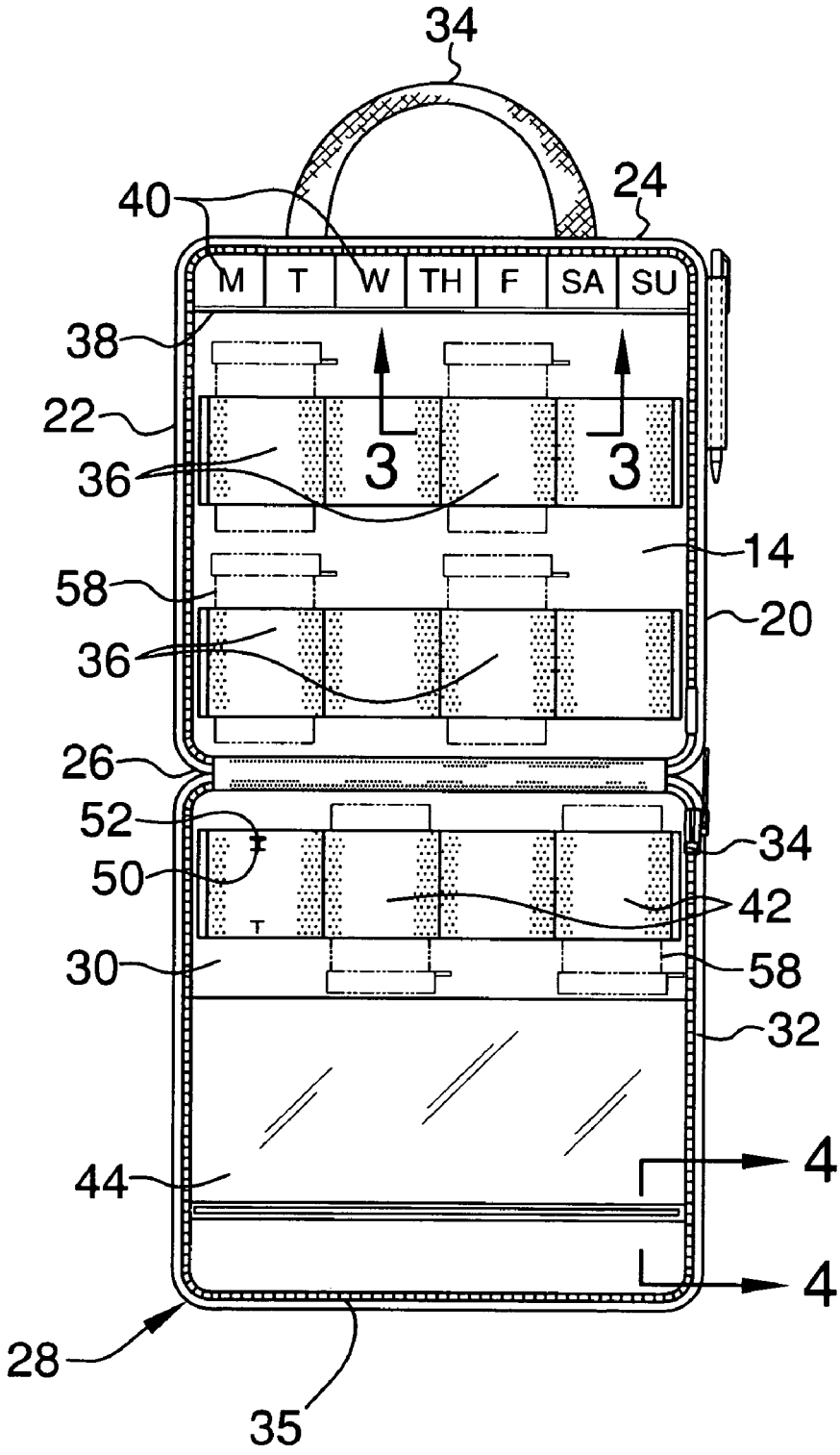
FIG. 2 is a front view of the present invention in an open configuration.
Figure 3:
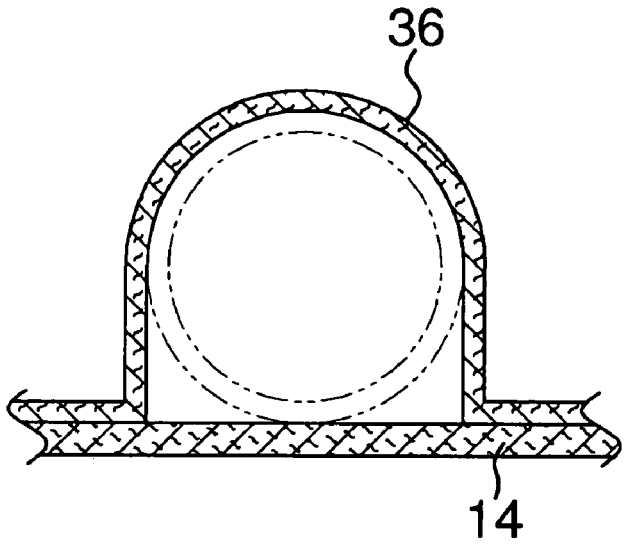
FIG. 3 is a cross-sectional view taken along line 3-3 of FIG. 2 of the present invention.
Figure 4:
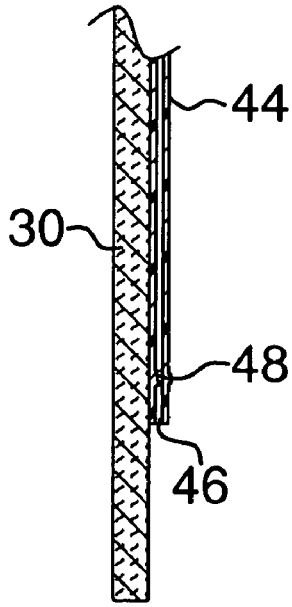
FIG. 4 is a cross-sectional view taken along line 4-4 of FIG. 2 of the present invention.
Figure 5:
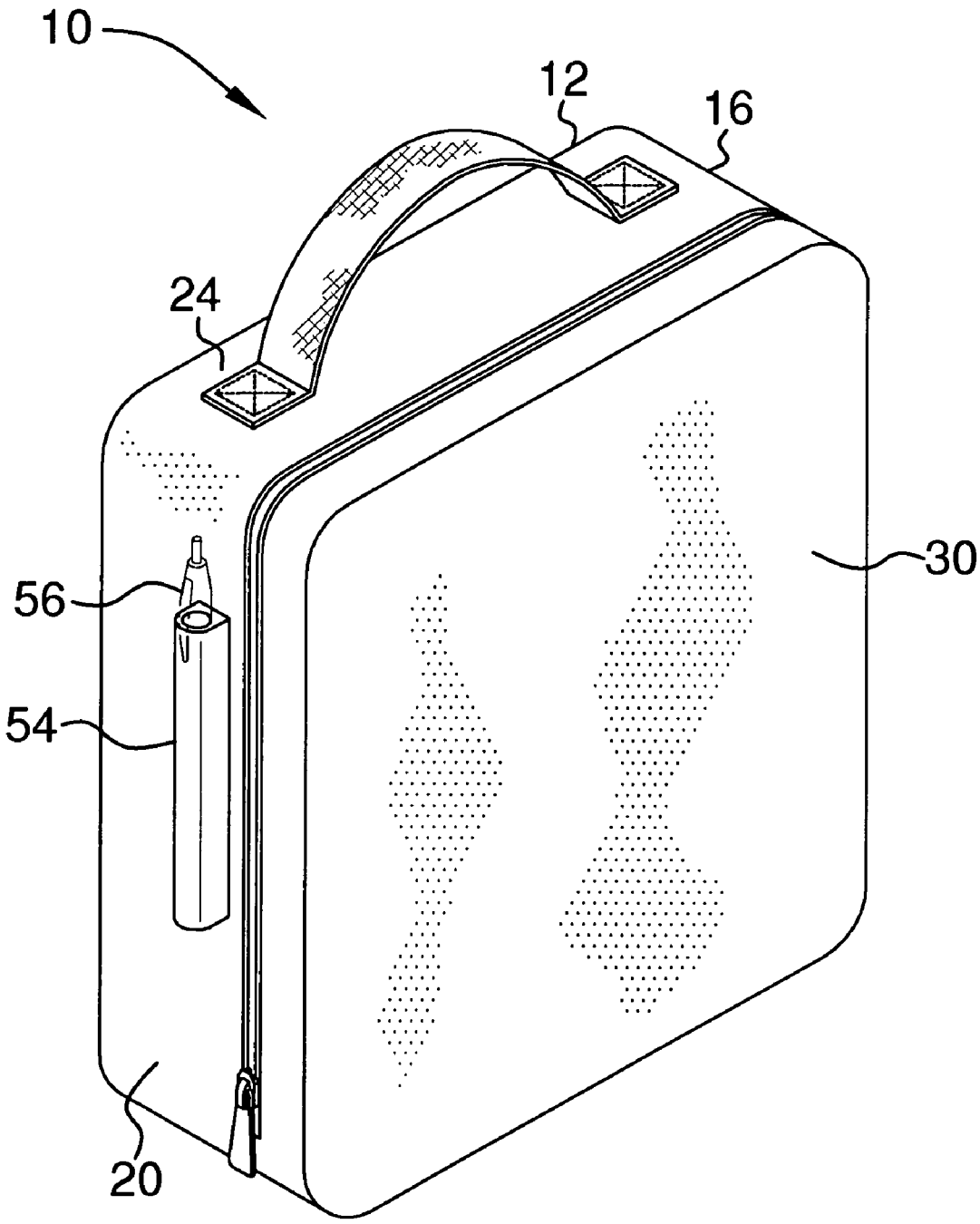
FIG. 5 is a perspective view of the present invention.

With reference now to the drawings, and in particular to FIGS. 1 through 5 thereof, a new medicine holding device embodying the principles and concepts of the present invention and generally designated by the reference numeral 10 will be described.

As best illustrated in FIGS. 1 through 5, the medicine holding assembly 10 generally comprises a housing 12 having a bottom wall 14 and a peripheral wall 16 that is attached to and extends upwardly from the bottom wall 14. The peripheral wall 16 includes a first side wall 20, a second side wall 22, a third side wall 24 and a fourth side wall 26. The housing 12 includes a cover 28 having a top wall 30 and a peripheral lip 32 is attached and extends downwardly from the top wall 30. The top wall 30 has a same size and shape as the bottom wall 14. The peripheral lip 32 is pivotally coupled to the fourth side wall 26 and the top wall 28 is selectively positionable in a closed position extending over the bottom wall 14 or an open position spaced from the peripheral wall 16. The housing 12 may be comprised of flexible material such as a cloth, leather or plastic material. A handle 34 is attached to an outer surface of the peripheral wall and is positioned on the third side wall 24.

A closure 35 is attached to the housing 12 and is configured to releasably secure the peripheral wall 16 to the peripheral lip 32 when the cover is in the closed position. The closure 34 includes a zipper that is attached to and extends along the third side wall 24, the first side wall 20 and the second side wall 22.

A plurality of bottom loops 36 is attached to an inner surface of the bottom wall 14. Each of the bottom loops 36 is comprised of a resiliently stretchable material. A pill case 38 is attached to and inner surface of the bottom wall 14. The pill case 38 is generally conventional and includes a plurality of compartments 40. Each of the compartments 40 is individually opened or closed. The pill case 38 abuts and is coextensive with an inner surface of the third side wall 24.

A plurality of top loops 42 is attached to an inner surface of the top wall 30. Each of the top loops 42 is comprised of a resiliently stretchable material. A bag 44 is attached to an inner surface of the top wall. The bag 44 has an opening 46 therein for accessing an interior of the bag 44. A sealing member 48 is mounted on the bag 44 and is configured to selectively seal the opening 46 in a closed position. The sealing member 48 includes interlocking members to form a substantially air and watertight seal.

An insulin pin holder 50 is mounted in the housing. The insulin pin holder 50 is positioned on the inner surface of the top wall 30 and is comprised of a panel having a pair of slits therein through which an insulin pin 52 may be extended.

A pen holder 54 is attached to an outer surface of the peripheral wall 16. The pen holder 54 comprises a sleeve configured for receiving a pen 56. The pen holder 54 is positioned on the first side wall 20.

In use, pill bottles 58 may be extended through either the top 42 or bottom loops 36 to hold the pill bottles 58 in place. The bag 44 may be used to hold items such as needles, bandages or other medications. The pill box 38 may be used for organizing pills that must be taken over a series of days.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pill holding apparatus configured for holding a plurality of pill bottles, said apparatus comprising:

a housing having a bottom wall and a peripheral wall being attached to and extending upwardly from said bottom wall, said peripheral wall including a first side wall, a second side wall, a third side wall and a fourth side wall, said housing including a cover having a top wall and a peripheral lip being attached and extending downwardly from said top wall, said top wall having a same size and shape as said bottom wall, said peripheral lip being pivotally coupled to said fourth side wall and said top wall being selectively positionable in a closed position extending over said bottom wall or an open position being spaced from said peripheral wall;

a closure being attached said housing and being configured to releasably secure said peripheral wall to said peripheral lip when said cover is in said closed position, said closure includes a zipper being attached to and extending along said third side wall, said first side wall and said second side wall;

a plurality of bottom loops being attached to an inner surface of said bottom wall, each of said bottom loops comprising a resiliently stretchable material;

a bag being attached to an inner surface of said top wall, said bag having an opening therein for accessing an interior of said bag, a sealing member being mounted on said bag and being configured to selectively seal said opening in a closed position; and a pill case being attached to said inner surface of said bottom wall, said pill case including a plurality of compartments, each of said compartments being individually opened or closed.

2. The apparatus according to claim 1, wherein said pill case abuts and is coextensive with an inner surface of said third side wall.

3. The apparatus according to claim 1, further including a plurality of top loops being attached to an inner surface of said top wall, each of said top loops comprising a resiliently stretchable material.

4. The apparatus according to claim 1, further including an insulin pin holder being mounted in said housing, said insulin pin holder being positioned on said inner surface of said top wall, said pin holder comprising a panel having a pair of slits therein through which an insulin pin is extendable.

5. The apparatus according to claim 3, further including an insulin pin holder being mounted in said housing, said insulin pin holder being positioned on said inner surface of said top wall, said pin holder comprising a panel having a pair of slits therein through which an insulin pin is extendable.

6. The apparatus according to claim 5, further including a pen holder being attached to an outer surface of said peripheral wall, said pen holder comprising a sleeve configured for receiving a pen, said pen holder being positioned on said first side wall.

7. The apparatus according to claim 1, further including a pen holder being attached to an outer surface of said peripheral wall, said pen holder comprising a sleeve configured for receiving a pen, said pen holder being positioned on said first side wall.

8. The apparatus according to claim 6, further including a handle being attached to an outer surface of said peripheral wall, said handle being positioned on said third side wall.

9. A pill holding apparatus configured for holding a plurality of pill bottles, said apparatus comprising:

a housing having a bottom wall and a peripheral wall being attached to and extending upwardly from said bottom wall, said peripheral wall including a first side wall, a second side wall, a third side wall and a fourth side wall, said housing including a cover having a top wall and a peripheral lip being attached and extending downwardly from said top wall, said top wall having a same size and shape as said bottom wall, said peripheral lip being pivotally coupled to said fourth side wall and said top wall being selectively positionable in a closed position extending over said bottom wall or an open position being spaced from said peripheral wall;

a closure being attached to said housing and being configured to releasably secure said peripheral wall to said peripheral lip when said cover is in said closed position, said closure including a zipper being attached to and extending along said third side wall, said first side wall and said second side wall;

a plurality of bottom loops being attached to an inner surface of said bottom wall, each of said bottom loops comprising a resiliently stretchable material;

a pill case being attached to said inner surface of said bottom wall, said pill case including a plurality of compartments, each of said compartments being individually opened or closed, said pill case abutting and being coextensive with an inner surface of said third side wall;

a plurality of top loops being attached to an inner surface of said top wall, each of said top loops comprising a resiliently stretchable material;

a bag being attached to an inner surface of said top wall, said bag having an opening therein for accessing an interior of said bag, a sealing member being mounted on said bag and being configured to selectively seal said opening in a closed position;

an insulin pin holder being mounted in said housing, said insulin pin being positioned on said inner surface of said top wall;

a pen holder being attached to an outer surface of said peripheral wall, said pen holder comprising a sleeve configured for receiving a pen, said pen holder being positioned on said first side wall; and a handle being attached to an outer surface of said peripheral wall, said handle being positioned on said third side wall.

10. A pill holding apparatus configured for holding a plurality of pill bottles, said apparatus comprising:

a housing having a bottom wall and a peripheral wall being attached to and extending upwardly from said bottom wall, said peripheral wall including a first side wall, a second side wall, a third side wall and a fourth side wall, said housing including a cover having a top wall and a peripheral lip being attached and extending downwardly from said top wall, said top wall having a same size and shape as said bottom wall, said peripheral lip being pivotally coupled to said fourth side wall and said top wall being selectively positionable in a closed position extending over said bottom wall or an open position being spaced from said peripheral wall;

a closure being attached said housing and being configured to releasably secure said peripheral wall to said peripheral lip when said cover is in said closed position, said closure includes a zipper being attached to and extending along said third side wall, said first side wall and said second side wall;

a plurality of bottom loops being attached to an inner surface of said bottom wall, each of said bottom loops comprising a resiliently stretchable material;

a bag being attached to an inner surface of said top wall, said bag having an opening therein for accessing an interior of said bag, a sealing member being mounted on said bag and being configured to selectively seal said opening in a closed position; and an insulin pin holder being mounted in said housing, said insulin pin holder being positioned on said inner surface of said top wall, said pin holder comprising a panel having a pair of slits therein through which an insulin pin is extendable.

11. The apparatus according to claim 10, further including a pill case being attached to said inner surface of said bottom wall, said pill case including a plurality of compartments, each of said compartments being individually opened or closed, said pill case abutting and being coextensive with an inner surface of said third side wall.

12. The apparatus according to claim 10, further including a plurality of top loops being attached to an inner surface of said top wall, each of said top loops comprising a resiliently stretchable material.

13. The apparatus according to claim 10, further including a pen holder being attached to an outer surface of said peripheral wall, said pen holder comprising a sleeve configured for receiving a pen, said pen holder being positioned on said first side wall.

14. The apparatus according to claim 10, further including a handle being attached to an outer surface of said peripheral wall, said handle being positioned on said third side wall.

* * * * *